US006305139B1

(12) United States Patent
Sauer

(10) Patent No.: US 6,305,139 B1
(45) Date of Patent: Oct. 23, 2001

(54) BEAM CLIP

(75) Inventor: Gale E. Sauer, Sinclairville, NY (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 09/134,679

(22) Filed: Aug. 1, 1998

(51) Int. Cl.[7] ..... E04B 9/22

(52) U.S. Cl. ..... 52/506.07; 52/664; 52/665; 52/668; 52/669; 52/484; 403/346; 403/347

(58) Field of Search ..... 52/506.07, 665, 52/664, 668, 669, 484; 403/346, 347

(56) References Cited

U.S. PATENT DOCUMENTS

| | | | | |
|---|---|---|---|---|
| 3,169,614 | | 2/1965 | McCoy . | |
| 3,221,466 | | 12/1965 | Downing, Jr. et al. . | |
| 3,891,332 | | 6/1975 | Molyneux et al. . | |
| 4,161,856 | | 7/1979 | Brown et al. . | |
| 4,317,318 | | 3/1982 | Sauer . | |
| 4,317,641 | | 3/1982 | Sauer . | |
| 4,499,697 | | 2/1985 | LaLonde . | |
| 4,525,973 | | 7/1985 | Vukmanic et al. . | |
| 4,535,580 | * | 8/1985 | Shirey | 52/484 |
| 4,611,453 | | 9/1986 | Worley . | |
| 4,648,230 | * | 3/1987 | Mieyal et al. | 52/667 |
| 4,785,603 | | 11/1988 | Platt . | |
| 4,989,387 | | 2/1991 | Vukmanic et al. . | |
| 5,271,202 | | 12/1993 | Vukmanic et al. . | |
| 5,517,796 | * | 5/1996 | Koski et al. | 52/506.07 |
| 5,687,525 | * | 11/1997 | Koski et al. | 52/506.07 |
| 5,839,246 | * | 11/1998 | Ziegler et al. | 52/506.07 |

* cited by examiner

*Primary Examiner*—Carl D. Friedman
*Assistant Examiner*—Christy M. Syres
(74) *Attorney, Agent, or Firm*—Eugene Chovanese

(57) ABSTRACT

A clip for attachment to the end of a main beam for a grid in a suspended ceiling. The beam has an inverted T cross section. The clip engages an identical clip on the end of another main beam to form an end to end connection. The clip has a tongue and channel that engages with a tongue and channel in the other clip of the connection.

11 Claims, 4 Drawing Sheets

BEAM CLIP

BACKGROUND OF THE INVENTION

1. Field of the Invention

This invention relates to clips that connect main beams together, end-to-end, in a grid structure for a suspended ceiling.

2. Background Information

Suspended ceilings having metal beams or runners that form grids to support panels are well known. Such grids have main beams or runners, and intersecting cross beams or runners. The beams are formed generally of flat sheet metal folded into an inverted T-shape, but in some instances are of extruded metal, such as aluminum. The main beams are secured end-to-end by connectors. The main beams are suspended from the structure ceiling by wires. The cross-beams are connected end-to-end through slots in the main beams and are supported by such main beams.

The main beams, which run parallel to one another, are generally spaced 48" apart. Crossbeams are connected to the main beams to form either 24"×24" rectangular openings, or 24"×48" openings, which receive the laid-in panels.

Such main beams in a suspended ceiling are subjected primarily to tension, compression, and bending stresses, and occasionally to twisting forces. The function of the connectors which join the generally 12 foot lengths of main beams together longtudinally is to maintain adequate strength and alignment.

Since the beam connections are end-to-end, the flanges, web, and bulb of each beam abuts the other, so that the connector has little to resist in compression. Of course, the connector must keep the ends of the beams aligned. Fire relief notches can be cut into the beam proper to provide for expansion relief in case of a fire, since there is no give at the beam end.

With respect to tension or pulling apart of the connection longitudinally, the connector is the sole means to resist such tension at the connection.

With respect to the resisting and bending, the connector, along with the beam-ends, provides resistance to such bending.

The connectors must resist the occasional twist.

SUMMARY OF THE PRESENT INVENTION

The present invention involves a pair of identical clips, each fastened to one end of a connector, which are engaged by bringing one toward another, endwise, to snap together.

The clips are attached to the ends of the beam by fasteners such as flat head rivets. Flanges extending along the upper and lower edges of a channel portion of the clip at the rear thereof receive and cradle a tongue portion from the opposing clip. A spring pocket in the channel of the clip receives the tongue of the clip to keep the clips laterally together. A detent at the front of each clip enters a cutout adjacent to the spring pocket whereby the clips are restrained from pulling apart in tension.

The various elements of the clip described above work together to resist the stresses imparted to the clip. In summary, the flanges and tongues created a fishplate splice by the overlap of connectors wherein (1) the connectors resist bending; (2) the detents and cut-outs prevent separation longitudinally by tension, (3) the ends of the beams are kept aligned by the connector elements to resist compression, and (4) all the elements cooperate to create a splice that resists twisting.

a) a clip of the invention in phantom in position on the end of the beam;

b) a clip in solid lines in exploded position away from the beam; and c) rivets that attach the clip to the beam in exploded position.

Figure 1:
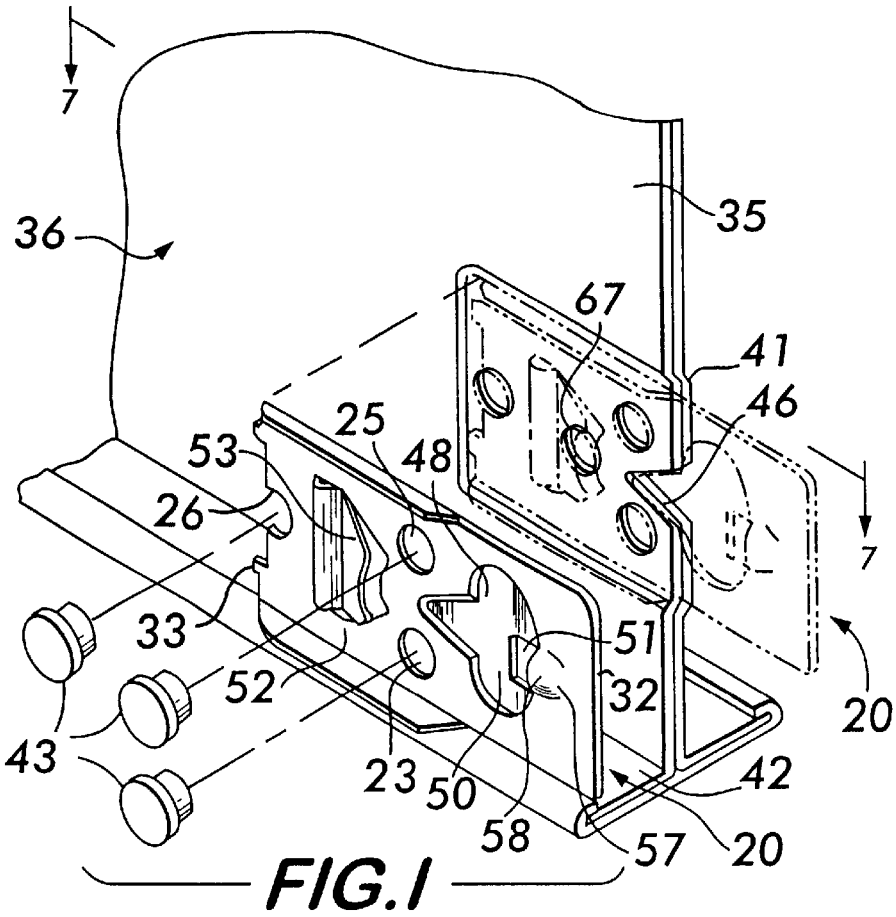
FIG. 1 is a partial isometric exploded view of the end of a main beam showing.
Figure 2:
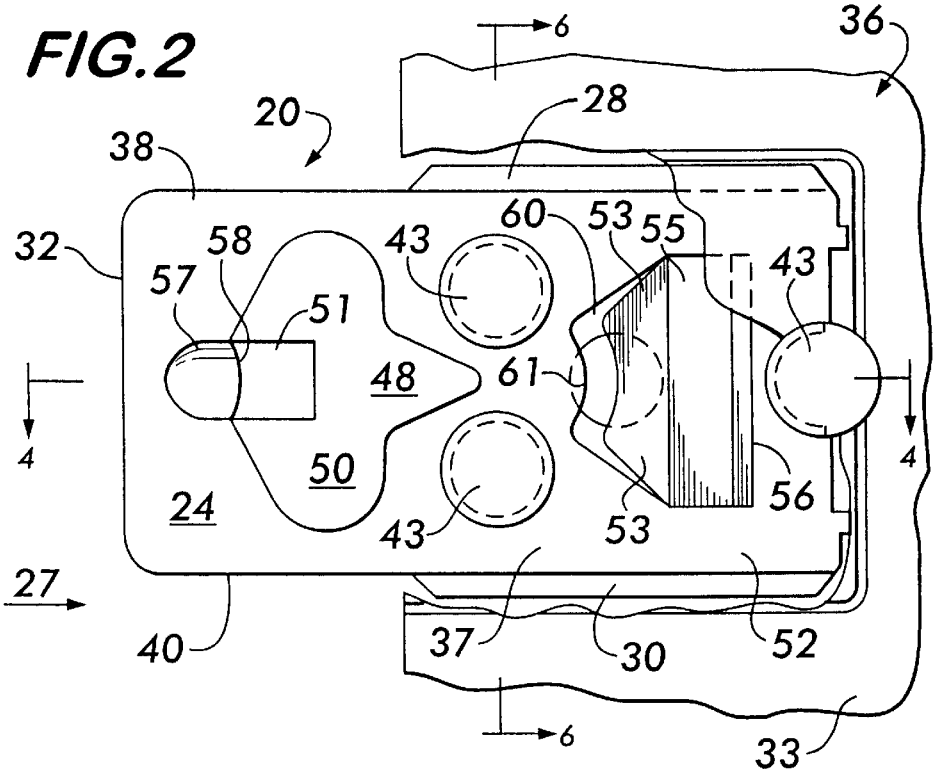

FIG. 2 is a side view of the clip showing the clip attached to the end of the beam, with a portion of the beam broken away, taken from the side of the beam away from the clip and the side of the clip opposite the one shown in FIG. 1.

Figure 3:
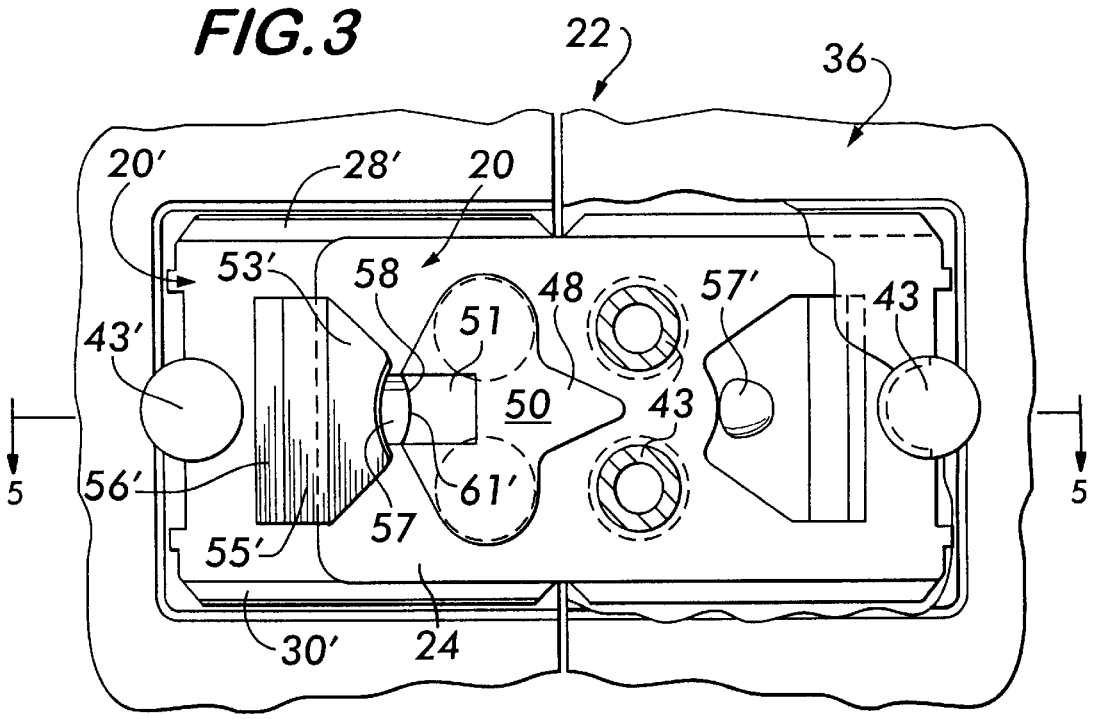

FIG. 3 is a side view similar to FIG. 2, showing two clips interconnected to form a beam connection.

Figure 4:
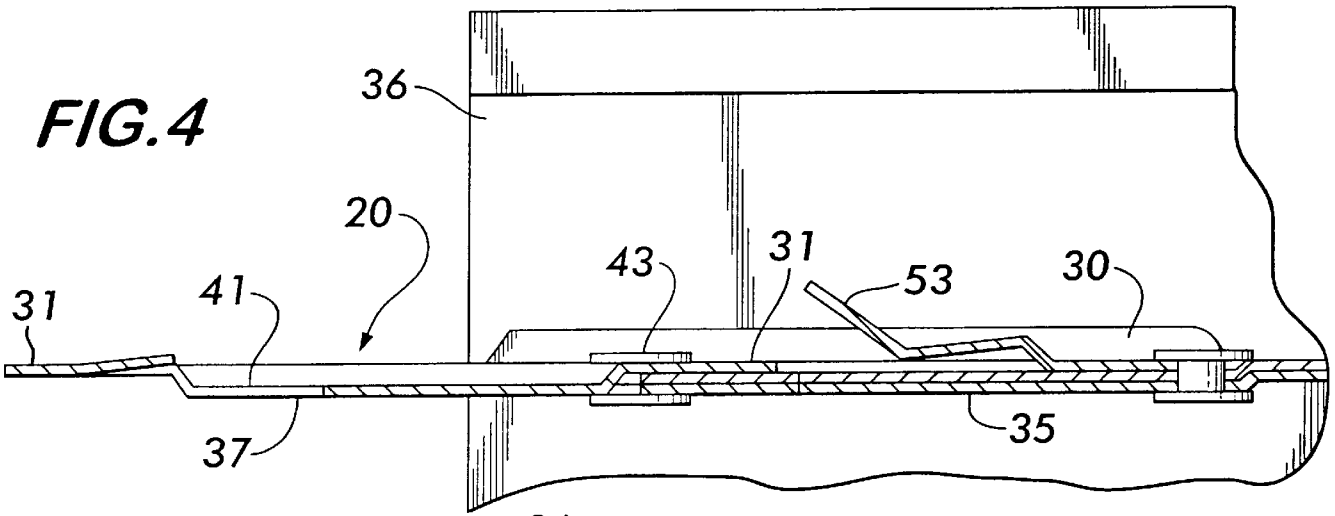

FIG. 4 is a top sectional view taken on the 4—4 of FIG. 2.

Figure 5:
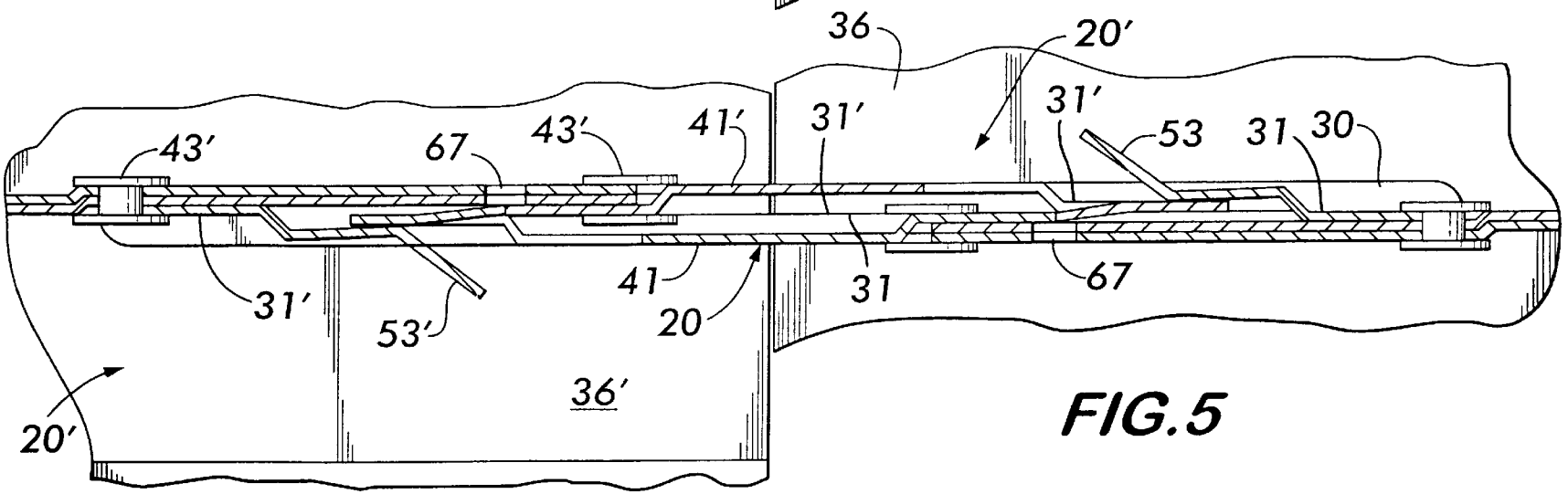

FIG. 5 is a top sectional view taken on the line 5—5 of FIG. 3.

Figure 6:
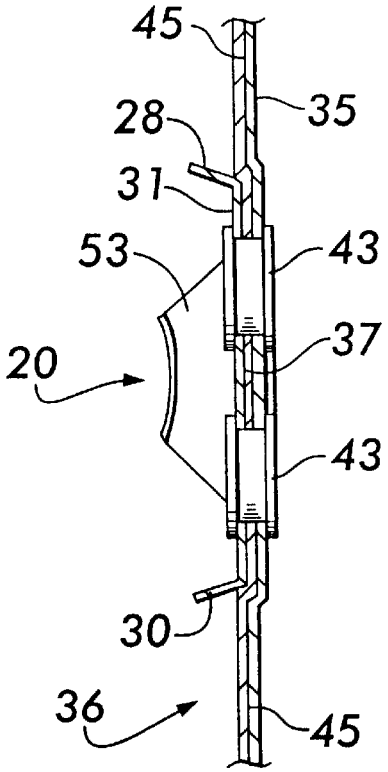

FIG. 6 is a vertical sectional view taken on the line 6—6 of FIG. 2.

Figure 7:
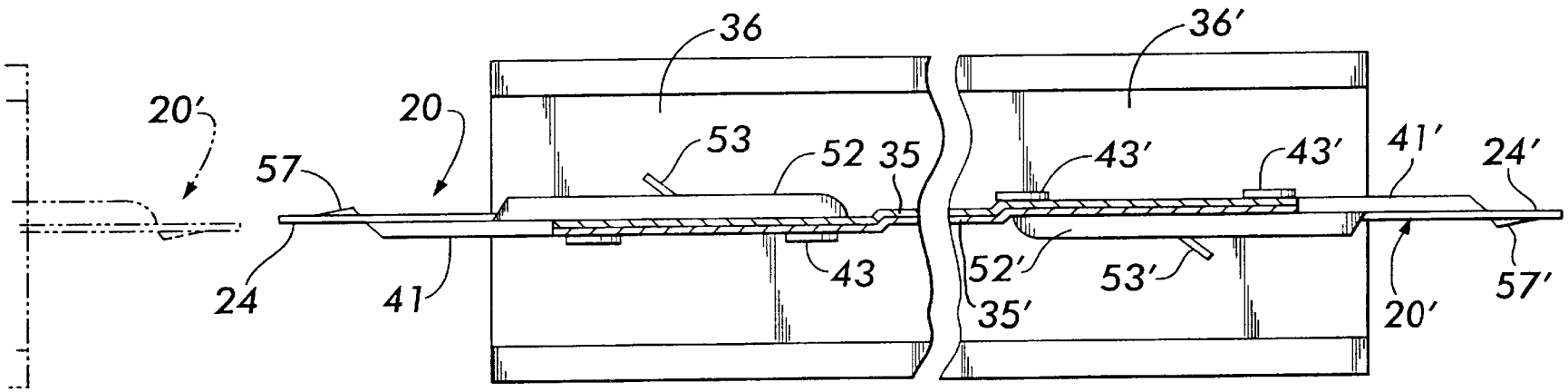

FIG. 7 is a top sectional view.

DESCRIPTION OF THE PREFERRED EMBODIMENT

Two clips 20 and 20' each identical to the other, are used to form a beam connection 22 of the invention as seen in FIG. 3. Clip 20 will be described with indentification numbers. Clip 20' will carry the same identification numbers with a primed(') notation.

Each clip 20 is roughly rectangular and is formed, preferably by stamping, from relatively hard steel, having spring properties. The clip can suitably have a thickness of 0.0150", with a generally rectangular dimension of ⅞" by 1½". Punched holes 23 and 25, are above one another, and are formed in the approximate center of the clip 20 as seen in FIG. 1. A third hole, 26, forming a triangle with the first two, is formed at the rear of the clip. Arrow 27, as seen in FIG. 2 points to the rear of the clip.

Flanges 28 and 30 are formed at the top and bottom edges of the rear of the clip 20, to form a channel 52. The flanges 28 and 30 are angled outwardly from what will be referred to as the laterally outward face 31 of the clip 20.

For purposes of this explanation, as seen in FIGS. 1 and 2 location 32 represents the front of the clip and location 33 the rear. As seen in FIG. 1, the face of the clip 20 that is seen is the lateral outward face 33, and the face of the clip that is not seen, and is intended to abut the web 35 of the grid beam 36, will be referred to as the lateral web face 37 of the clip 20. The clip 20 has a top 38 and bottom 40.

A tongue 24 extends in a forward direction at the front 32 of the clip 20.

As seen particularly in FIG. 1, the grid web 35 has a pan 41 or depressed section formed in the end of the beam 36. As is common with rolled section T-beam grids, the grid beam 36 is formed of a folded strip of flat metal, into a web 35 with a bulb on top and a flange 42 below. The web 35 is formed of two adjacent layers, as clearly seen in FIG. 1.

The pan 41, which is rectangular, and of a size that slightly exceeds the rectangular dimension of the channel 52 of clip 20, only so as to nest the channel 52 of clip 20 in the pan and restrain movement in the plane of the web. The pan 41 is pressed to a depth that depends on the thickness of clip 20. When the clip 20 is attached to the web 35 in the depressed pan 41 by flat head rivets 43 through pre-punched holes 23,25 and 26 in the pan 41, the lateral outward face 31 of the clip 20 will lie in the vertical plane 45 that extends between the layers in the web 35, which is the vertical center plane of the total web 35.

The pans 41 are formed into the web 35 at the each end of each beam 36, so that the beams 36 and 36' can be connected end to end by the clips 20 and 20' of the invention. The pans 41 and 41' are formed into the web 35 from opposite sides of the web 35 at each end of the beam 36 as seen in FIG. 7.

The beam web 35 also has a V-shaped notch cutout 46 formed in the pan 41 as seen for instance in FIG. 1. This notch cutout 46 receives a corresponding V-shaped wedge projection from the clip in the form of a stem 48 that protrudes from the clip 20 on the lateral web face 37, and is depressed into the clip on lateral outward face 31. This stem 48 nests in the notch cutout 46 of the web 35 and serves to secure the clip 20 on the web 35 along with the rivets 43. Forward of the stem 48, the projection extends in a form of an extended circular portion that creates a cap 50 in a modified mushroom shape, with the stem 48 extending horizontally when the clip 30 is in place in the ceiling, while the cap 50 of the mushroom shape extends vertically.

There is a rectangular cutout 51 at the forward part of cap 50, and a pressed out detent 57 projecting from clip 20 beyond the laterally outward face 31 of the clip 20 at the front of cap 50 adjacent cutout 51. Detent 57 has a rearward facing pointed edge 58.

The two flanges 28 and 30 at the top and bottom of the clip 20 are angled outward from the lateral outward face 31 of the clip 20 to form a rear channel 52. The flanges extend along the rear channel 52 of the clip 20 on the part that lies abutting the web 35.

A spring pocket 53 is formed on the clip 20 in channel 52, which faces foward and is angled away from the lateral outward face 31. The rearward part of the pocket 53 has a portion 55 which folds back toward the lateral outward face 31. The pocket 53 is joined to the outward face of the clip at the fold line 56. The entire pocket is stamped from the flat clip 20, leaving a cutout portion 60 having a rearward pointing arcuate edge 61.

Two clips 20 and 20', each identical to the other, and each fastened to one end of each beam 36 and 36', are engaged by simply forcing one clip 20 longitudinally into another 20', wherein the tongue 24 of one clip 20 engages the pocket 53' of the other clip 20' as seen in FIG. 3. The clips 20 and 20' are forced toward one another. This is done by directing the tongue 24 and 24' of each of the clips 20 and 20' toward the pocket 53 and 53' on the other clips. This will bring the lateral outward faces 31 and 31' of the clips of the 30 and 30' together. The tongue 24 and 24' of each clip will be centered and guided within the rearward portion of the other clip by the flanges at the top and bottom of the clip.

Detents 57 and 57' on each clip 20 and 20' will initially ride within the depressed of stems 48 and 48', which will permit the faces 31 and 31' to be in contact with one another. As each clip is brought forward with respect to the other, the lateral outward faces 31 and 31' of the clips 20 and 20' will be forced slightly apart as the detents 57 and 57', permitting each clip face to override the flat head rivets 43.

As the clips advance toward one another, the tongues 24 and 24' of clips 20 and 20' continue to be guided by the upper and lower flanges on each clip.

The clips 20 and 20' will finally lock with one another when detent 57 enters cutout 60', and detent 57' enters cutout 60, at which time the spring pocket 53 and 53' of each clip will bring the faces 31 and 31' back in abutment against one another as seen in FIG. 5. Edge 58 on detent 57 will engage edge 61 on cutout portion 60', in a hooked manner and edge 50' on detent 57' will engage edge 61, in a similar manner. At this position, the ends of the grid flanges, webs, and bulbs will abut.

The connection is now complete, with each clip engaging the other in the following manner:

Laterally

The clips 20 and 20' will be held lateral outward face 31 to lateral outward face 31', in abutting relationship, by tongue 24 engaging spring pocket 53', and tongue 24' engaging spring pocket 53 as seen in FIGS. 3 and 5. The forward end 32 of the tongue 24 will extend under the portion of the pocket which, in a relaxed position, extends into the laterally outward face of the web. It is sprung from this relaxed position to the extent of the thickness of the tongue 24, which it must accommodate and secure. Since both tongues are secured in opposed pockets, the clips are securely held against lateral separation. Longitudinaly to resist Compression.

Since the ends of the beams abut in alignment and each end is squarely cut and are held by the clip against separation, the connection resist compression.

Longitudinally to Resist Tension

Detents 57 and 57' are held laterally in cutouts 60' and 60 by the spring pockets 53 and 53' so the faces 31 and 31' cannot laterally separate. A hole 67 in web 35 permits detent to further seat under the bias of the spring pocket 53. When held in the cutout 60, the clips resists separation by tension since the detent 57 which is pointed toward the rear of the clip 20, abuts against an arcuate edge 61 of the cutout and in effect is hooked on. The detents can be removed from the pocket by forcing back both spring pockets 53 and 53' with a pry tool, both at the same time. The connections can then be disassembled by reversing the assembling steps. The connection can also be disassembled by the following steps: 1) push together, 2) twist, and 3) pull apart.

Bending

Each tongue 24 and 24' fits into the channel 52 and 52' on the other clip, and is held laterally in the channel by the spring pocket 53 and 53'. The clips 20 and 20' are secured longitudinally to one another as explained above. By nesting the tongues and channels in this fashion, a fishplate splice is created wherein the interconnected clips 20 and 20' lap the joint of grid beams 36 and 36' and are secured to the webs 35 and 35' of the end beams so as to connect the beams 36 and 36' end to end. This fishplate effect can particularly be seen in FIGS. 3 and 5.

Where the clips 20 and 21' are used with grid beams having single thickness webs, including, extruded beams of for instance aluminum, the pan 41 and 41' again must be formed in the web 35. The depth of the pan 41 and 41' should be such that when the clip of the invention is secured by the flat head rivets 43, the lateral outward face 31 and 31' of the clip should lie in the vertical center plane 45 of the web 35.

I claim:

1. A connection for joining abutting main beams end to end in a suspended horizontal ceiling grid, each beam having an inverted T cross-section with a vertical web and flange, comprising:

A) a pair of clips overlapped and each identical to the other, engaged with each other, each clip having a) a lateral web face and a lateral outward face, b) a portion forming a forward tongue, c) a portion forming a channel rearward of the tongue, having flanges at the upper and lower edges of the clip, and open on the lateral outward face, d) a spring pocket in the channel open toward the forward tongue and protruding on the lateral outward face, e) a cutout in the channel, and f) a detent on the tongue protruding on the lateral outward face;

B) a depressed pan formed into the web at an end of each beam to a depth beyond a vertical center plane of the web, and, C) means to secure the channel of each clip to the end of each beam so that, a) the tongue extends beyond and forward of the beam end, b) the lateral web face on the channel portion of the clip abuts the pan in the web on the beam end, and c) the lateral outward face of the clip lies in substantially the vertical center plane of the web;

wherein, when the clips are overlapped and engaged with each other, a) the tongue of each clip is confined in the channel, within the flanges, of the other clip, b) the detent on the tongue of each clip engages the cutout in the channel of the other clip, and c) the tongue of each clip is secured in the spring pocket of the other clip;

whereby the engaged clips form a splice about the ends of the beams wherein a) the beam ends and webs are aligned and in an abutting relationship;

b) the beam webs are overlapped by each clip;

c) the clips are secured together and are abutted and overlapped and d) the lateral outward faces of the clips abut and lie in substantially the vertical center plane of the aligned webs.

2. The connection of claim 1 wherein the clip has a depression in the laterally outward face having a forward stem in the form of a wedge and a rearward portion in the form of a modified mushroom cap, wherein the detent on the other clip, during the engagement of the clips, first lies in the wedge portion of the depression and is forced out of the wedge portion, whereby the lateral outward faces are forced apart during engagement prior to being fully engaged when the lateral outward faces remain in an abutting relationship.

3. The connection of claim 2 wherein the lateral outward faces are forced apart to avoid interference with rivet fastening means.

4. The connection of claim 2 wherein the cap portion of the depression avoids interference by the lateral outward face with the rivet fastening means, when the clips are engaged.

5. The connection of claim 2 wherein the wedge depressions on the lateral outward face forms a projection on the lateral web face, the beam has a wedge cutout on the beam end, and the fastening means keep the wedge projection in the wedge cutout.

6. A fishplate splice for lapping an end to end joint of aligned main beams in a horizontal suspended ceiling grid, each beam having an inverted T cross section with a vertical web, wherein:

a) the fishplate is in the form of a pair of clips, each of which has a forward tongue and a rearward channel, b) the pair of clips overlap with each other for a substantial portion of their length, and interlock with each other, with the tongue of each clip confined in the channel of the other;

c) the fishplate lies substantially in a vertical center plane of the webs of the beams;

d) the beams each have a web depression; and e) each of the clips in the fishplate is attached to one of the beams in the web depression of the beam by fasteners.

7. A clip attached to the end of a main beam capable of being assembled with another said clip on another main beam to ridgedly join the beams end to end, each beam having an inverted T cross-section with a vertical web and flange, each clip having:

A)

a) a lateral web face and a lateral outward face, b) a portion forming a forward tongue, having flanges at the upper and lower edges of the clip, c) a portion forming a channel rearward of the tongue, having flanges at the upper and lower edges of the clip, and open on the lateral outward face, d) a spring pocket in the channel open toward the forward tongue and protruding on the lateral outward face, e) a cutout in the channel, and f) a detent on the tongue protruding on the lateral outward face;

B) a depressed pan formed into the web at an end of each beam to a depth beyond a vertical center plane of the web, and, C) means to secure the channel of each clip to the end of each beam so that, a) the tongue extends beyond and forward of the beam end, b) the lateral web face on the channel portion of the clip abuts the pan in the web on the beam end, and c) the lateral outward face of the clip lies in substantially the vertical center plane of the web;

wherein, when assembled together, the clips are overlapped and engaged with each other, d) the tongue of each clip is confined in the channel, within the flanges, of the other clip, e) the detent on the tongue of each clip engages the cutout in the channel of the other clip, and f) the tongue of each clip is secured in the spring pocket of the other clip;

whereby the assembled clips form a splice about the ends of the beams wherein a) the beam ends and webs are aligned and in an abutting relationship;

b) the beam webs are overlapped by each clip;

c) the clips are secured together and are abutted and overlapped and d) the lateral outward faces of the clips abut and lie in substantially the vertical center plane of the aligned webs.

8. The clip of claim 7 wherein the clip has a depression in the laterally outward face having a forward stem in the form of a wedge and a rearward portion in the form of a modified mushroom cap, wherein the detent on the other clip, during the assembly of the clips, first lies in the wedge portion of the depression and is forced out of the wedge portion, whereby the lateral outward faces are forced apart during engagement prior to being fully engaged when the lateral outward faces remain in an abutting relationship.

9. The clip of claim 8 wherein, when assembled, the lateral outward faces are forced apart to avoid interference with rivet fastening means.

10. The clip of claim 8 wherein, when assembled, the cap portion of the depression avoids interference by the lateral outward face with the rivet fastening means, when the clips are engaged.

11. The clip of claim 8 wherein, when assembled, the wedge depressions on the lateral outward face forms a projection on the lateral web face, the beam has a wedge cutout on the beam end, and the fastening means keep the wedge projection in the wedge cutout.

* * * * *

UNITED STATES PATENT AND TRADEMARK OFFICE

CERTIFICATE OF CORRECTION

PATENT NO. : 6,305,139 B1
DATED : October 23, 2001
INVENTOR(S) : Gail E. Sauer

It is certified that error appears in the above-identified patent and that said Letters Patent is hereby corrected as shown below:

Title page,
Item [74], *Attorney, Agent, or Firm,* "Eugene Chovanese" should read;
-- [74] *Attorney, Agent or Firm* — Eugene Chovanes --

Signed and Sealed this

Twenty-first Day of June, 2005

JON W. DUDAS
*Director of the United States Patent and Trademark Office*